US005950820A

United States Patent [19]

Heinze, IIII

[11] Patent Number: 5,950,820

[45] Date of Patent: Sep. 14, 1999

[54] DISPLAY KIT CONTAINING GREETING CARD, GIFT, BOX AND WRAP

[76] Inventor: Frank D. Heinze, IIII, 3090 N. Rio Baya, Indialantic, Fla. 32903

[21] Appl. No.: 09/152,705

[22] Filed: Sep. 14, 1998

Related U.S. Application Data

[60] Provisional application No. 60/088,554, Jun. 9, 1998.

[51] Int. Cl.[6] ..... B65D 75/00

[52] U.S. Cl. ..... 206/232; 53/474; 206/459.5; 206/470

[58] Field of Search ..... 206/223, 232, 206/457, 459.5, 461–471, 574, 736; 53/474

[56] References Cited

U.S. PATENT DOCUMENTS

| | | | |
|---|---|---|---|
| 4,840,275 | 6/1989 | Fiaola et al. | 206/575 |
| 5,251,759 | 10/1993 | Gannon et al. | 206/575 |
| 5,289,917 | 3/1994 | Chabria | 206/461 |
| 5,292,003 | 3/1994 | Baghdassarian | 206/575 |
| 5,575,384 | 11/1996 | Saye | 206/232 |
| 5,673,796 | 10/1997 | Tulloch | 206/758 |
| 5,740,959 | 4/1998 | Savage | 229/103.3 |
| 5,875,893 | 3/1999 | Lee et al. | 206/471 |

*Primary Examiner*—Jim Foster
*Attorney, Agent, or Firm*—Charles E. Wands

[57] ABSTRACT

A greeting card and gift display kit is configured to instill a sense of surprise in an examining customer, so that the customer feels as though he or she is the recipient of a gift, and thereby receives emotional enjoyment, and is motivated to purchase the card and gift for someone else. The kit includes a transparent display case containing a gift box in which both the gift and the card are inserted upside-down, plus wrapping materials for the gift box. The greeting card is placed on top of the box lid facing the front side of the display case, so that a 'gift-related' expression on the greeting card is viewable through the front of the display case. A folded card containing use instructions and an aperture for viewing the open gift box from the rear of the display case is inserted in the bottom of the display case. A portion of the folded card extends to a front side of the display case and contains a phrase suggesting that the purchaser turn the display case over to its reverse side, whereby the customer can be 'surprised' by the gift that is viewable through the aperture in the card stock. The display case further includes a pouch, into which the gift is inserted when placed with the greeting card inside the gift box, to be wrapped and presented to the intended recipient.

20 Claims, 2 Drawing Sheets

DISPLAY KIT CONTAINING GREETING CARD, GIFT, BOX AND WRAP

CROSS-REFERENCE TO RELATED APPLICATION

The present application claims the benefit of U.S. Provisional Patent Application Ser. No. 60/088,554, filed Jun. 9, 1998, entitled: "Gift Box Display Configuration," the disclosure of which is incorporated herein.

FIELD OF THE INVENTION

The present invention relates in general to greeting card and gift merchandise, and is particularly directed to a readily displayed ensemble of materials including display case, greeting card, a 'novelty' type gift associated with the message contained on the greeting card, and components for packaging and wrapping the gift and the greeting card together.

BACKGROUND OF THE INVENTION

The greeting card and gift industry currently employs a wide variety of packaging and display schemes for facilitating customer selections. When purchasing a greeting card, the customer may typically peruse a card rack containing a substantial selection of diverse types of cards, and then make a selection based upon an emotional response to the message on the card and the purchaser's relationship with the intended recipient. When the card being purchased is to accompany a gift, not only may the customer's selection not necessarily be related to the gift, but the card is normally segregated from the gift when the two are presented to the recipient.

While common custom may include presenting the card and the gift together, the recipient will usually open and read the card first, and then open the gift. Because this is often an emotional occasion, if this sequence (card first, gift second) is interrupted, it may detract from the intent of the card and gift on the recipient, particularly where surprise is desired.

SUMMARY OF THE INVENTION

In accordance with the present invention, there is provided a new and improved greeting card and associated gift display ensemble or kit, that is configured to present a prospective greeting card and gift customer with a sense of surprise—since the gift itself is not immediately apparent when initially examining the ensemble. This sense of surprise makes the purchasing customer feel as though he or she is the recipient of the gift, so that the purchaser receives emotional enjoyment from examining the kit, and is thereby motivated to purchase the card and gift within the kit for someone else.

To this end, the greeting card and gift display kit of the present invention comprises a transparent display case that is sized to contain each of a gift and greeting card containing a message that associates or implies (e.g., humorously) a relationship with the gift. The display case also includes a gift box in which both the gift and the card are inserted, and wrapping materials for the gift box. The gift box has a lid and is retained upside-down within the transparent display case in an open condition, with the bottom of the gift box resting in its lid, so that the gift box is open upside-down facing a bottom or rear side of the display case.

The greeting card is placed on top of the lid facing the front side of the display case, so that the greeting expression on the greeting card is viewable through the front of the display case, and thereby immediately readable by the customer. The wrapping material is placed in a second portion of the display case alongside or adjacent to the upside-down gift box. A folded web of card stock material containing use instructions and an aperture for viewing the open gift box from the back side of the display case is inserted in the bottom of the display case.

A folded portion of the card stock material extends to a front side of the transparent display case and contains information, in the form of a suggestive phrase, for example, which 'guides' a prospective purchaser to turn the display case over to its reverse side, so that the customer can be 'surprised' by the gift that is viewable through the aperture in the card stock material. The display case further includes a container, such as a pouch, into which the gift is insertable and being sized to be placed with the gift inside the box.

The pouch is retained beneath the wrapping material in the second portion of said transparent display case. The pouch is closed by a drawstring that is attached to the greeting card. This not only ensures that both the greeting card and the gift will be hidden together in the box until the gift box lid is removed, but prevents them from becoming separated, when the gift box is unwrapped and opened by the recipient, so that the 'suggestive' connection of the expression on the greeting card with the contents of the pouch (the gift) will not be lost on the recipient.

DETAILED DESCRIPTION

Figure 2:
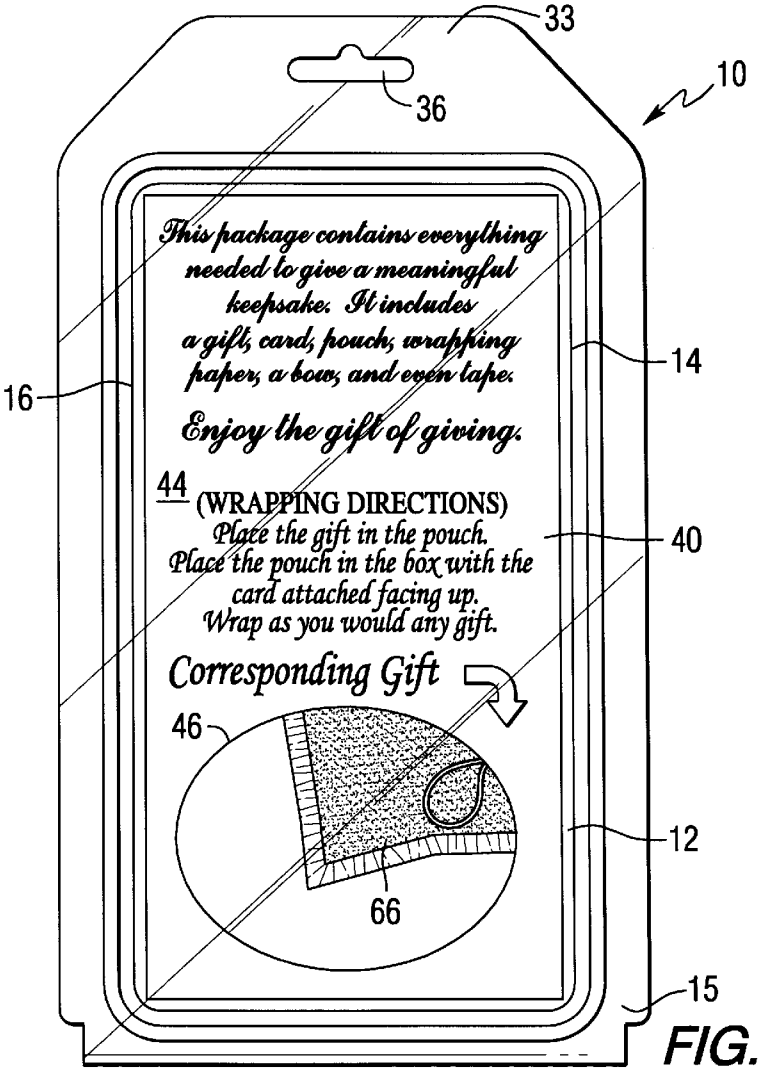
FIG. 2 is a diagrammatic bottom or rear view of the greeting card and gift display ensemble/kit of the present invention.
Figure 1:
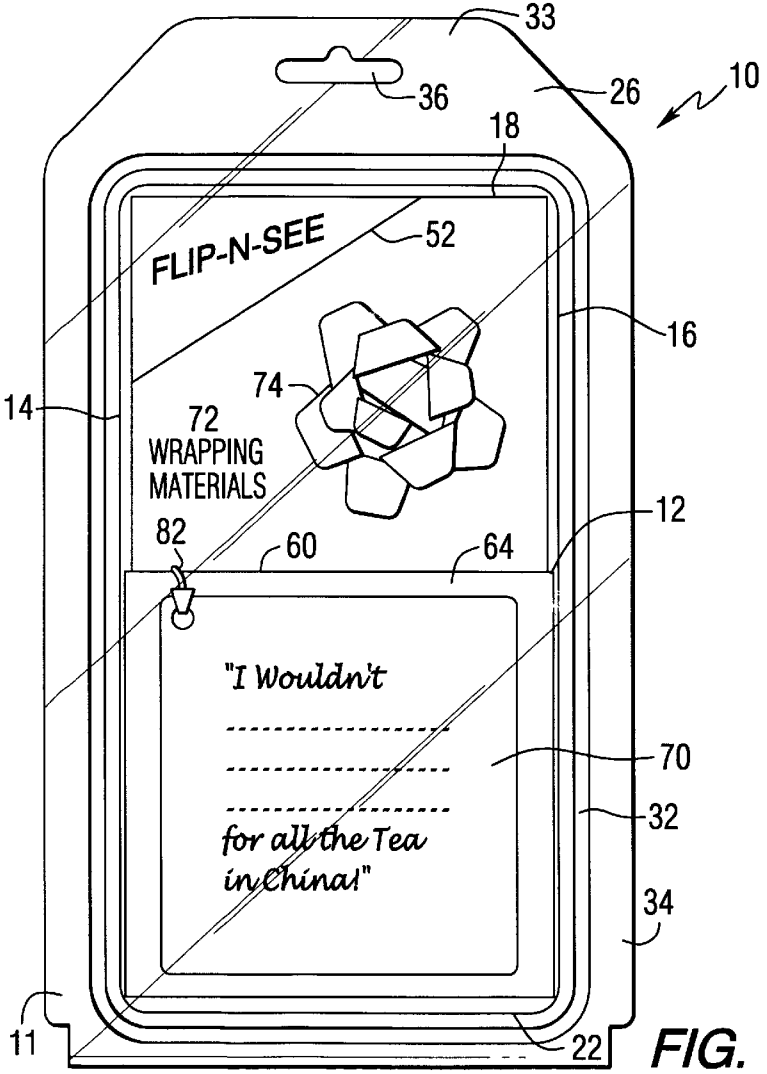
FIG. 1 is a diagrammatic front view of the greeting card and gift display ensemble/kit of the present invention.
Figure 3:
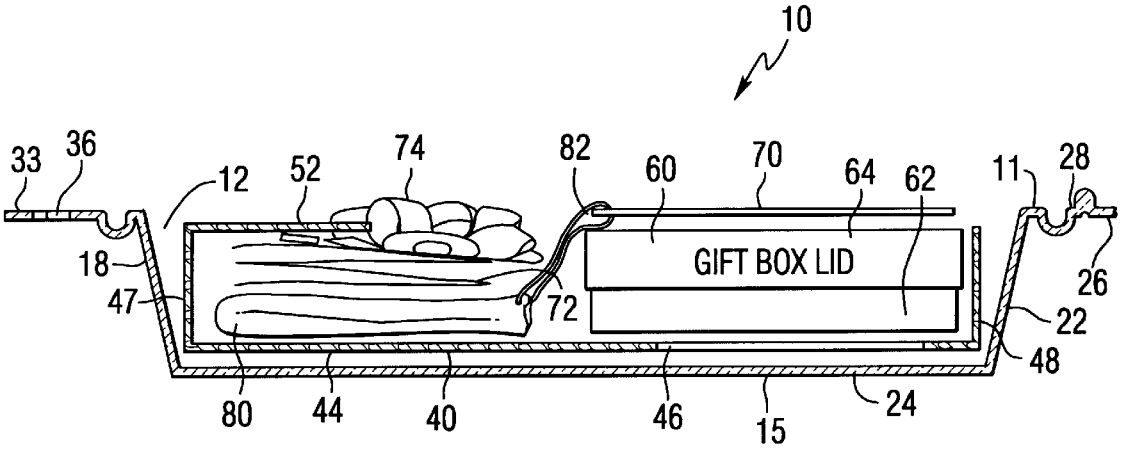
FIG. 3 is a diagrammatic side view of the greeting card and gift display ensemble/kit of the present invention.

Referring now to FIGS. 1–3, the greeting card and gift display ensemble/kit of the present invention is diagrammatically illustrated as comprising a transparent display case 10, of a type customarily used in the retails sales industry, in which each of a greeting card, box and wrapping components for its associated gift are packaged. As a non-limiting example, the display case 10 may comprise a standard transparent plastic display package or container, such as one that is generally rectangularly configured, as a generally tray-shaped storage shell or compartment 12, formed by parallel sidewalls 14 and 16 and endwalls 18 and 22 joined therewith, each sidewall and endwall extending from a floor or bottom 24 to define the depth of the shell 12.

The front side 11 of the display package 10 is recloseable by means of a transparent plastic lid or cover 26 integrally attached to the storage shell 12, as by means of a folded hinge joint 28 at endwall 22. The cover 26 is slightly oversized relative to the storage compartment 12 and may contain a perimeter rim 32, which is sized and shaped to engage an associated perimeter grooved lip 34, that is integral with and surrounds the top edges of the sidewalls 14/16 and endwalls 18/22. In addition, respective end portions 33 of the cover's perimeter rim 32 and the shell's grooved lip 34 have apertures 36 that become aligned with one another when the lid 26 is closed against the storage shell 12, so as to allow the display case to be readily hung on a support rod of a standard display rack (not shown).

A folded web of card stock material 40, the bottom side 42 of which contains use instructions 44 and an aperture 46, is inserted into the shell 12, so that folded portions 47 and 48 of the card stock 40 are adjacent to respective endwalls 18 and 22. A further folded portion 52, which may be shaped as a generally triangular shaped portion, as a non-limiting example, projects from the folded portion 47, so that it partially overlies the storage compartment 12 directly beneath the lid 26, when the lid is closed against the storage compartment 12. This further folded portion 52 of the card stock material 40 contains information, in the form of a suggestive phrase, for example the suggestive mark/logo "Flip-N-See," which 'urges' or 'inspires' an individual viewing the front of the display case to turn the display case over to its rear side 13, thereby revealing the interior portion of the storage shell 12 which is exposed through the aperture 46 in the folded web of card stock material 40. As pointed out briefly above, it is directly behind this aperture 46 that the gift is revealed, so that the customer may be 'surprised' when he or she turns the display case over.

For this purpose, a gift box 60 is inserted into the display case 10 in an upside-down orientation, with the bottom 62 of the gift box resting in its lid 64, so that the gift box 60 is open. The open gift box is placed directly over the aperture 46 in the card stock web 40, thereby making the contents of the gift box viewable through the transparent bottom or floor 24 of the display case 10. Prior to placing the gift box 60 into the display case shell 12, the gift of interest 66 (a tea bag in the illustrated example) is placed in the gift box 60, thereby making the gift (e.g., 'tea bag') directly viewable to the customer through the aperture 46 in the web of card stock material 40 at the bottom of the shell 12, when the customer turns the display case over.

A greeting card 70, which is sized proximate to but slightly smaller than the gift box lid 64, is placed on top of the lid facing the front side 11 of the display case 10, so that the greeting expression on the greeting card (e.g., "I wouldn't_for all the tea in China!") is viewable through the front side of the display case, and thereby immediately readable by the customer, when the display package is placed for display on a retail gift/card shop rack or the like. A folded arrangement of wrapping materials 72, which may include wrapping paper, adhesive, bow 74 and the like, is placed beneath the further folded portion 52 of the card stock, so that it is adjacent to the (upside-down) gift box 60.

Also included as part of the display case packaging is a gift container, such as a (felt) pouch 80, into which the gift 66 is insertable when placed in the gift box 60 by the purchaser for presentation to the gift recipient. The pouch is retained within the display case 10 beneath the wrapping materials 70, and is closed by a drawstring 82 that is attached to the greeting card 70. By placing the gift in the pouch and having the greeting card attached to the pouch within the gift box, the purchaser is assured that both the greeting card and the gift will be hidden together in the gift box until the gift box lid is removed by the recipient. It also prevents them from becoming separated, when the gift box is unwrapped and opened, so that the recipient is assured of experiencing the desired surprise of associating the expression on the greeting card with the contents of the pouch (the gift). The use of a pouch also allows the purchaser to 'hide' or include another gift, such as a piece of jewelry, purchased separately, for the occasion.

As will be appreciated from the foregoing description, the greeting card and associated gift display kit of the present invention is configured to present a prospective greeting card/gift purchaser customer with a sense of surprise in the course of examining the display kit—as the gift itself is not immediately apparent, when initially viewing the front side of the display case. This sense of surprise makes the purchasing customer feel as though he or she is the recipient of the gift, so that the purchaser receives emotional enjoyment from examining the kit and is thereby encouraged to purchase the card and gift within the kit for a recipient. Since the kit includes a gift pouch attached to a greeting card that is sized to fit within the gift box, the purchaser is assured that both the greeting card and the gift will be hidden together in the gift box until the gift box lid is removed by the recipient. This serves to have the recipient of experience the desired surprise of associating the expression on the greeting card with the contents of the pouch (the gift).

While I have shown and described an embodiment in accordance with the present invention, it is to be understood that the same is not limited thereto but is susceptible to numerous changes and modifications as are known to a person skilled in the art, and I therefore do not wish to be limited to the details shown and described herein, but intend to cover all such changes and modifications as are obvious to one of ordinary skill in the art.

What is claimed:

1. A self-contained gift, box, wrapping and display ensemble comprising:

a transparent display case that is configured to be supported via a display rack;

a gift box having a lid and being sized to be retained upside-down within a first portion of said transparent display case in an open condition, with the bottom of said gift box resting in said lid, so that said gift box is open upside-down and faces a bottom side of said transparent display case;

a gift placed with said gift box as retained open and upside-down in said transparent display case;

wrapping material retained in a second portion of said transparent display case; and a first insert of web material that is sized to be retained within said transparent display case adjacent to said bottom side thereof, said first insert having an aperture through which said gift in said gift box is viewable through said bottom side of said transparent display, with said gift box retained upside-down within said first portion of said transparent display case in said open condition.

2. A self-contained gift, box, wrapping and display ensemble according to claim 1, further including a second insert of web material that is sized to be retained within said transparent display case adjacent to a front side thereof and containing information guiding an individual viewing said front side of said display case to turn said display case upside-down and thereby reveal said gift in said gift box through said aperture in said first insert adjacent to said bottom side of said transparent display case.

3. A self-contained gift, box, wrapping and display ensemble according to claim 2, further including a third insert of web material containing information associated with said gift, and being sized to be insertable within said box with said gift and retained within said first portion of said transparent display case between said lid and said front side of said transparent display case, so that said information is viewable through said first side of said transparent display case.

4. A self-contained gift, box, wrapping and display ensemble according to claim 3, further including a container into which said gift is insertable and being sized to be placed with said gift inside said gift box, and being retained together with said wrapping material in said second portion of said transparent display case.

5. A self-contained gift, box, wrapping and display ensemble according to claim 4, wherein said container is pouch-configured, and is closed by a drawstring that is attached to said third insert of web material.

6. A self-contained gift, box, wrapping and display ensemble according to claim 2, wherein said first and second inserts of web material comprise first and second portions of a folded web of card stock material.

7. A self-contained gift, box, wrapping and display ensemble according to claim 6, wherein said first portion of said folded web of card stock material contains information representative of the contents of said transparent display case and the use of said contents.

8. A self-contained display kit for a greeting card, gift, box and wrapping therefor comprising a transparent display case, said greeting card containing information associated with said gift, and being insertable within said box, said box having a lid and being retained upside-down within a first portion of said transparent display case in an open condition, with the bottom of said box resting in a lid therefor, so that said box is open upside-down facing a bottom side of said transparent display case, said gift being placed within said box, wrapping material retained in a second portion of said transparent display case, and a first insert of web material retained within said transparent display case adjacent to said bottom side thereof, said first insert having an aperture through which said gift in said box is viewable through said bottom side of said transparent display, said greeting card being placed within said first portion of said transparent display case between said lid and said front side of said transparent display case, so that said information on said greeting card is viewable through said first side of said transparent display case.

9. A self-contained display kit according to claim 8, further including a second insert of web material adjacent to a front side of transparent display case and containing information guiding an individual to turn said display case upside-down and thereby reveal said gift in said box through said aperture in said first insert.

10. A self-contained display kit according to claim 9, further including a container into which said gift is insertable and being sized to be placed with said gift inside said box, and being retained together with said wrapping material in said second portion of said transparent display case.

11. A self-contained display kit according to claim 10, wherein said container is pouch-configured, and is closed by a drawstring that is attached to said greeting card.

12. A self-contained display kit according to claim 11, wherein said first and second inserts of web material comprise first and second portions of a folded web of card stock material, said first portion of said folded web of card stock material containing information representative of the contents of said transparent display case and the use of said contents.

13. A method of packaging a gift, box and wrapping material in a compact display ensemble comprising the steps of:

(a) providing a transparent display case that is configured to be supported by a display rack;

(b) installing a first insert of web material adjacent to a bottom side of said transparent display case, said first insert of web material having an aperture through which a first portion of said transparent display case is viewable;

(c) placing a gift in a gift box, and the bottom of said gift box in a lid therefor, and installing said gift box within said first portion of said transparent display case, so that said gift box is open upside-down facing said bottom side of said transparent display case, allowing said gift to be viewed through said aperture in said first insert of web material; and (d) placing wrapping material in a second portion of said transparent display case.

14. A method according to claim 13, further including the step (e) of installing a second insert of web material within said transparent display case adjacent to a front side thereof, said second insert of web material containing information guiding an individual viewing said front side of said display case to turn said display case upside-down and thereby reveal said gift in said gift box through said aperture in said first insert adjacent to said bottom side of said transparent display case.

15. A method according to claim 14, further including the step of (f) installing a third insert of web material, containing information associated with said gift and being insertable within said box with said gift, within said first portion of said transparent display case between said lid and said front side of said transparent display case, so that said information associated with said gift is viewable through said first side of said transparent display case.

16. A method according to claim 15, wherein said third insert of web material comprises a greeting card.

17. A method according to claim 16, wherein step (d) further includes installing a container, into which said gift is insertable and sized to be placed with said gift inside said gift box, together with said wrapping material in said second portion of said transparent display case.

18. A method according to claim 17, wherein said container is pouch-configured, and is closed by a drawstring that is attached to said greeting card.

19. A method according to claim 14, wherein said first and second inserts of web material comprise first and second portions of a folded web of card stock material.

20. A method according to claim 19, wherein said first portion of said folded web of card stock material contains information representative of the contents of said transparent display case and the use of said contents.

* * * * *